US009701369B2

(12) United States Patent
Nielson

(10) Patent No.: US 9,701,369 B2
(45) Date of Patent: Jul. 11, 2017

(54) OFFSHORE TOP SITE SYSTEM

(71) Applicant: National Oilwell Varco Denmark I/S, Brondby (DK)

(72) Inventor: Morten Storgaard Nielson, Copenhagen N (DK)

(73) Assignee: NATIONAL OILWELL VARCO DENMARK I/S, Brondby (DK)

( * ) Notice: Subject to any disclaimer, the term of this patent is extended or adjusted under 35 U.S.C. 154(b) by 94 days.

(21) Appl. No.: 14/409,074

(22) PCT Filed: Jun. 12, 2013

(86) PCT No.: PCT/DK2013/050190
§ 371 (c)(1),
(2) Date: Dec. 18, 2014

(87) PCT Pub. No.: WO2013/189496
PCT Pub. Date: Dec. 27, 2013

(65) Prior Publication Data

US 2015/0136008 A1 May 21, 2015

(30) Foreign Application Priority Data

Jun. 21, 2012 (DK) ..... 2012 70350

(51) Int. Cl.
*B63B 35/44* (2006.01)
*B63B 9/06* (2006.01)
(Continued)

(52) U.S. Cl.
CPC ..... *B63B 35/4413* (2013.01); *B63B 9/065* (2013.01); *E21B 17/015* (2013.01); *E21B 19/004* (2013.01); *E21B 43/0107* (2013.01)

(58) Field of Classification Search
CPC ..... B63B 9/065; B63B 35/44; B63B 35/4413; B63B 2035/448; E21B 17/012; E21B 17/015; E21B 19/004; E21B 43/0107
(Continued)

(56) References Cited

U.S. PATENT DOCUMENTS 4,637,336 A * 1/1987 Engelskirchen ..... B63B 22/021 114/230.2
6,123,114 A 9/2000 Seguin
(Continued)

FOREIGN PATENT DOCUMENTS

EP 2 042 682 A2 4/2009
FR 2 916 795 A1 12/2008
(Continued)

OTHER PUBLICATIONS

"Recommended Practice for Flexible Pipe", ANSI/API Recommended Practice; 17B, Fourth Edition, Jul. 2008; pp. 1-213.
(Continued)

*Primary Examiner* — Ajay Vasudeva
(74) *Attorney, Agent, or Firm* — Pearne & Gordon LLP

(57) ABSTRACT

The invention relates to an offshore top site system comprising a subsea facility, a floating unit arranged above the subsea facility and at least one transportation line extending between the subsea facility and the floating unit. The transportation line comprises a catenary riser section and comprises an uppermost end and a top site section with a lowermost end. The catenary riser section and the top site section are in flow connection with each other. The transportation line further comprises a connecting portion preferably arranged within a vertical floating unit zone and between the top site section and the uppermost end of the riser section. The connection portion is pivotally connected to the floating unit. The connection portion is preferably
(Continued)

pivotally connected to the floating unit such that at least a major part of pulling force from the riser section is alleviated by the connection to the floating unit.

24 Claims, 11 Drawing Sheets

(51) Int. Cl.
*E21B 17/01* (2006.01)
*E21B 43/01* (2006.01)
*E21B 19/00* (2006.01)

(58) Field of Classification Search
USPC ..... 114/264, 265; 441/3–5; 405/158, 169, 405/224.2, 224.3
See application file for complete search history.

(56) References Cited

U.S. PATENT DOCUMENTS

| | | | | |
|---|---|---|---|---|
| 6,685,397 | B1 * | 2/2004 | Dixon-Roche | E21B 17/015 166/352 |
| 6,739,804 | B1 * | 5/2004 | Haun | E21B 17/015 166/355 |
| 6,811,355 | B2 * | 11/2004 | Poldervaart | B63B 21/50 114/230.1 |
| 7,024,941 | B2 | 4/2006 | Andersen | |
| 7,770,532 | B2 * | 8/2010 | Bauduin | B63B 21/50 114/230.2 |
| 8,172,481 | B2 * | 5/2012 | Luppi | E21B 17/015 166/350 |
| 8,418,766 | B2 * | 4/2013 | Luppi | E21B 43/013 166/338 |
| 8,550,171 | B2 * | 10/2013 | Wajnikonis | E21B 17/015 166/346 |
| 2004/0057798 | A1 | 3/2004 | Grobe | |
| 2011/0026031 | A1 | 2/2011 | Kristiansen et al. | |
| 2014/0079512 | A1 | 3/2014 | Christensen | |

FOREIGN PATENT DOCUMENTS

| | | | | |
|---|---|---|---|---|
| GB | 2 334 048 | A | 8/1999 | |
| GB | 2478119 | A | 8/2011 | |
| NO | GB 2313889 | B * | 3/2000 | E21B 17/015 |
| WO | 00/63598 | A1 | 10/2000 | |
| WO | 01/30646 | A1 | 5/2001 | |
| WO | 2008/152289 | A2 | 12/2008 | |
| WO | 2011/042023 | A1 | 4/2011 | |
| WO | 2013/182196 | A1 | 12/2013 | |

OTHER PUBLICATIONS

"Specification for Unbonded Flexible Pipe"; ANSI/API Specification 17J; Third Edition, Jul. 2008; pp. 1-73.

API Specification 17E; Specification for Subsea Umbilicals; ISO 13628-5; Oct. 15, 2002; pp. 1-103.

Rombado, et al.; "Steel Catenary Jumper for Single Hybrid Riser in Deepwater Applications"; Offshore Technology Conference; Houston, Texas, USA; Apr. 30-May 3, 2012.

Luo, et al.; "Permanent versus disconnectable FPSOs"; Journal of Marine Science and Application; 2009; pp. 93-98.

Houston, et al., "Independence Hub and Trail—Part One", Enterprise Products Partners L.P., May 26, 2005.

Song, et al., "Deepwater Tieback SCR: Unique Challenges and Solutions", Apr. 30, 2007, Retrieved from the Internet: URL:https://www.onepetro.org/conference-paper/OTC-18524-MS?sort=&start=O&q=otc+I8524&from year=&peer reviewed=&published between=&fromSearchReSu1ts=true&to_year=&rows=I0#, Retrieved on Jun. 6, 2016.

Wajnikonis, et al., "Improvements in Dynamic Loading of Ultra Deepwater Catenary Risers", May 7, 2009, Retrieved from the Internet: URL:https://www.onepetro.org/conference-paper/OTC-20180-MS?sort=&start=O&q=otc+20180&,from_year=&peer_reviewed=&published_between=&fromSearchResults=true&to_year=&rows=I0#, Retrieved on Jun. 6, 2016.

Remery, et al., The Hybrid Catenary Riser (HCR): A New and Optimised Riser Configuration for Ultra Deep Water:, Deep Offshort Technology International Conference, Nov. 1, 2000, pp. 1-15.

Candelier, et al., "A Versatile Dry-tree Solution for Simulteneous Drilling, Production and Well Intervention Operations for Mild Environment: The Wellhead Barge", Mar. 25, 2011, Retrieved from the Internet: URL:https://www.onepetro.org/conference-paper/OMC-2011-029?sort=&start=O&q=A+VERSAT1LE+DRY-TREE+SOLUTJON+FO+SIMULTENEOUS+DRILLJNG%2C+PRODUCTJON+AND+WELL+JNTERVENTJON+OPERAT1-0NS+FOR+MJLD+ENVJRONMENT%3A+THE+WELL, retrieved on Apr. 21, 2016, pp. 14-15.

Supplementary European Search Report for 13 80 6225 dated Jun. 6, 2016.

* cited by examiner

OFFSHORE TOP SITE SYSTEM

TECHNICAL FIELD

The invention relates to an offshore top site system for deep water application comprising transporting flowing media such as fluids, electricity and electromagnetic signals which are transferred to or from a floating subsea facility and a floating unit floating in a position above the subsea facility, e.g. on a sea surface.

BACKGROUND ART

Offshore top site systems of this technical field are well known in the art. The floating unit is often a production platform or a vessel. Such floating units of offshore site systems are often referred to as FPSO units (floating production, storage and offloading units) or FSO units (floating storage and offloading units) depending on if the respective floating unit is adapted for processing hydrocarbons or not.

Such offshore top site systems often comprise a plurality of transportation lines extending between the floating unit and a subsea facility such as a well, a production equipment, a mid-water arch or a similar subsea facility. Such transportation lines are for example applied for transporting hydrocarbons and/or signals (via an optical fiber sensor) to the floating unit, water, $CO_2$, drilling fluid, energy and other flowing media to the subsea facility. The transportation lines are often in the form of pipes or umbilicals.

For reducing the movements of the floating unit the floating unit will normally be moored using mooring lines, for example by mooring the floating unit to the seabed, to a tower or to one or more anchored buoys.

The transportation lines of such offshore top site systems are often rather heavy and provide a considerable pulling force at the point where they are connected to the floating unit.

Even though the floating unit is moored, weather conditions and tides provide high dynamic movements of the floating unit and the transportation lines including displacement motions (heave, sway, drift, and/or surge) and angular motions (yaw, pitch, and/or roll).

Offshore top site system comprising a floating unit (FPSO and FPO) has therefore mainly been used at shallow water applications, such as 300 m or less, where the transportation lines applied have been selected to be relatively small.

Further, such prior art offshore system has mainly been applied on sites with only minor currents and waves and often the offshore system has been equipped with relative expensive quick-release couplings to the transportation lines, which is adapted to be released in situation of increased currents and waves.

In order to apply offshore top site system comprising a floating unit (FPSO and FPO) at deeper water it has been attempted to alleviate the dynamic movements of the floating unit and the transportation lines by providing the floating unit with a turret system which alleviates some of the turning and rotational movements resulting from waves and winds. In situations where the transportation line is a steel pipe it is normally required that the floating unit should be equipped with a turret system.

Such turret systems are however rather expensive. Further it has been found that such turret systems do not to a sufficient degree alleviate the movements resulting from tides and vertical movements (heave) in general.

The connection from a transportation line to a floating unit is often rather stiff, e.g. provided by bolting a flange of an end of the transportation line to the floating unit. Such a connection will inevitably be subjected to very high and often damaging stress which leads to excessive fatigue and results in the need of replacement of expensive transportation lines.

WO 01/30646 describes a suspension device for a riser, for connecting the riser to piping on a fixed or floating platform such that the weight of the riser is transferred to the platform via an essentially moment-free hanger, thereby avoiding the use of quick-release couplings adapted to be released in situation of increased bending movements. The suspension device of WO 01/30646 has never been applied in practice.

US 2004/0057798 describes a steel catenary riser (SCR) system which is coupled to a vessel by a tensioning mechanism arranged on the floating vessel such as to ensure that a substantially constant tension is applied to the SCR such that the touchdown point of the SCR on the seabed is maintained stable. The SCR has an upper portion, which extends above the surface of the body of water and which is connected to the tensioning mechanism. This system is however only suitable at very shallow water since the control of the SCR is very limited and the risk collision with the vessel increases with the depth of the water due to the relative larger horizontal movement. For the same reason the described steel catenary system is not suitable for a system comprises several rises. Additionally it is generally desired to keep the number of moving mechanical facilities as low as possible, because the high forces such facilities will be subjected to require often repair or replacement, which results in temporary stop of production.

In situations where the transportation line is of the flexible type e.g. as described in standard "Recommended Practice for Flexible Pipe", ANSI/API 17 B, fourth Edition, July 2008, and the standard "Specification for Unbonded Flexible Pipe", ANSI/API 17J, Third edition, July 2008, it is often desired to apply a bend stiffener for protection of the flexible pipe against bend stress immediately adjacent to the connection to the floating unit. However, where the flexible pipe is relatively long, such about 1500 m or longer, experience has shown that the bend limiter is not sufficient to alleviate the stress resulting from vertical movements of the floating unit and the bend limiter almost merely has the function of moving the point of stress resulting from vertical movements to immediately below the bend limiter. Even though the bending moments immediately adjacent to the floating unit are relatively small where the water is deep and flexible pipe is long, the weight of the flexible pipe tends to result in undesired fatigue of the flexible pipe in the area where it is connected to the floating unit

DISCLOSURE OF INVENTION

An object of the invention is to provide an offshore top site system for deep water applications where the above described problems has been at least partly solved. It is in particular an object of the invention to provide an offshore top site system for deep water applications comprising one or more transportation lines and which is suitable for transporting flowing media between a subsea facility at deep water and a floating unit, wherein the risk of fatigue of the transportation line is relatively low, and simultaneously where the requirement for expensive, movable mechanical equipment is reduced. Simultaneously it is an object to provide an offshore top site system which is simple and cost effective.

These and other objects have been solved by the invention as defined in the claims and as described herein below.

It has been found that the invention and/or embodiments thereof have a number of additional advantages which will be clear to the skilled person from the following description.

The offshore top site system of the invention comprises a subsea facility, a floating unit arranged above the subsea facility and at least one transportation line extending between the subsea facility and the floating unit i.e. arranged to provide a transport of at least one flowing medium between the subsea facility and the floating unit.

The transporting line(s) may be any kind of transporting line(s) which are used in such offshore systems e.g. for transporting fluids, electricity and/or electromagnetic signals. Relatively stiff transportation line(s) such as a steel catenary riser (SCR) can be applied as well as flexible pipe(s) and hybrid comprising at least one flexible length section and at least one relatively stiff section e.g. a SCR section. However, in general flexible transportation lines are preferred. Examples of transportation line(s) and various sections thereof are described further below.

The transporting line may for example be or comprise a pipe riser or an umbilical. Preferably the offshore top site system comprises a plurality of transporting lines e.g. comprising a plurality of rises, such as a plurality of pipe risers and optionally at least one umbilical. Transporting lines, such as flexible transporting lines—are well known in the art and are e.g. described in standard "Recommended Practice for Flexible Pipe", ANSI/API 17 B, fourth Edition, July 2008, and the standard "Specification for Unbonded Flexible Pipe", ANSI/API 17J, Third edition, July 200. Pipe risers are usually applied for transportation of petrochemical products from the seabed to a sea surface installation such as a weathervaning vessel. Umbilicals are often used for transporting fluids, electricity, signals and other to and/or from installations at or beyond the seabed. Umbilicals are e.g. described in API Specification 17E, Specification for Subsea Umbilicals—ISO 13628-5: 2002.

In an embodiment of the invention the transportation line is a pipe for transporting a fluid, such as a hydrocarbon product, drilling fluid, $CO_2$ and water. Such transportation line can e.g. comprise a fiber sensor as it is well known e.g. from U.S. Pat. No. 7,024,941, US 2011/0026031 and WO 2011/042023.

In an embodiment of the invention the transportation line is a pipe for injecting fluids e.g. into a well.

In an embodiment of the invention the transportation line is a high pressure pipe arranged for transporting fluids at a pressure of at least about 50 bars, such as at least about 100 bars.

Where the transportation line is a pipe it will normally have a bore diameter of at least about 8", or preferably at least about 10" which is the size of pipes most often used for deep water applications.

In an embodiment of the invention the transportation line is an umbilical and/or a subsea cable for example for transportation of electricity, signals and/or drilling fluid. Optionally the umbilical and/or the subsea cable comprise a fiber sensor.

In the description of the invention the term transportation line used in singular should be interpreted to also include the plural version transportation lines unless otherwise specified (e.g. by specifying that there is a single transportation line).

The floating unit can for example be a platform or a vessel. In an embodiment the floating platform is a semi-submersible. In an embodiment the floating platform is a Tension Leg Platform (TLP). The present invention is in particular advantageous where the floating unit is a vessel, because the offshore top site system of the invention is in particular simple to install. Vessels that have not even been built for the purpose of providing a floating unit for an offshore top site system can in a simple way and at relatively low cost be modified to constitute a floating unit of the offshore top site system of the invention.

The floating unit has a bottom facing downwards and an outer periphery of the bottom defining a horizontal periphery of a vertical floating unit zone.

The term 'riser' is herein used to designate a transportation line with a generally vertical orientation e.g. a pipe riser for transportation of fluid or a cable riser for transportation of electricity, signals and similar. An umbilical is usually a riser of the cable comprising several elements i.e. of cable type riser(s) and/or pipe type riser(s).

The transportation line comprises a catenary riser section and a top site section in flow connection with each other. The catenary riser section has a length of at least about 1500 m and has an uppermost end from where it extends downwards and comprises at least one catenary. A catenary riser should herein be interpreted to mean a transportation line comprising at least one catenary curved section i.e. at least one free hanging curved section where the curve is due to gravity and/or buoyancy module(s)—e.g. simple gravity induced catenary, lazy wave or steep wave configurations. Further information about a catenary can be found in the above mentioned API standards.

The term 'uppermost' and 'lowermost' when used in connection with the transportation line and parts thereof should be interpreted to mean in relation to the distance along the transportation line determined from the subsea facility i.e. 'uppermost' means with the longest distance along the transportation line to the subsea facility and 'lowermost' means with the shortest distance along the transportation line to the subsea facility.

Entirely vertical risers without catenary are not suitable in the offshore top site system of the invention, because the risk of collisions or other damage of the system due to the connection to the floating unit would be too high in particular for production systems for use at deep water. Further, such entirely vertical risers are expensive to install and also the connection to the floating unit will ultimatively result in high stress and resulting fatigue of the vertical riser in the area of connection due to the high and varying forces applied in this area when the floating unit is subjected to excessive heave.

The top site section and the catenary riser section can be equal or different from each other in structure and/or material.

In an embodiment the top site section of the transportation line is a metal jumper, such as a steel jumper, e.g. a steel catenary jumper.

A metal jumper is herein defined as a pipe structure comprising a fluid impermeable metal tube layer as a bearing structure of the pipe. In many situations the metal tube will substantially be constituted by the metal tube layer optionally with a protective outer coating and/or a protective liner. Generally it is desired that the metal tube layer is a steel tube layer, e.g. as described in "Steel Catenary Jumper for Single Hybrid Riser in Deepwater Applications" Rombado et al. Offshore Technology Conference Houston, Tex., USA, 30 Apr.-3 May 2012.

In an embodiment the top site section of the transportation line is a flexible jumper, such as an unbonded flexible jumper or a bonded flexible jumper.

Generally, a metal jumper is less expensive than a flexible jumper. However, since the present invention ensures a reduced load on the top site section of the transportation line, the strength requirements to the top site section will be highly reduced compared to prior art offshore top site system and therefore the cost of the top site section will in general be relatively low and also the cost difference between selecting a metal jumper and a flexible jumper will be reduced.

The top site section is preferably arranged to lead the transportation line to the point of the offshore top site system where it is desired, e.g. to a tank or an electric supply and/or control unit. Due to the present invention it is now possible to hold the top site section very stable and thereby any risk of damage of the top site section is thereby reduced.

The catenary riser section may be in one or in several sections of equal or of different structure and/or materials.

In an embodiment at least an uppermost part of the catenary riser section is a metal riser section, such as a steel riser section. In an embodiment the whole of the catenary riser section is a catenary metal riser section.

In an embodiment at least an uppermost part of the catenary riser section is a catenary metal riser section, i.e. comprising a catenary curved section.

In an embodiment at least an uppermost part of the catenary riser section is a metal riser section which does not have a catenary curved section, i.e. it is essentially straight.

A metal riser section is herein defined as a pipe structure comprising a fluid impermeable metal tube layer as a bearing structure of the pipe. In many situations the metal tube will substantially be constituted by the metal tube layer optionally with a protective outer coating and/or a protective liner. Generally it is desired that the metal tube layer is a steel tube layer.

A catenary metal riser section is herein defined as a metal riser section comprising at least one catenary curved section. The catenary metal riser can comprise two or more catenary curved sections.

In an embodiment the catenary riser section is arranged in a wave configuration, such as a Lazy wave, a steep wave or a pliant wave configuration.

In an embodiment the catenary riser section is arranged in a free hanging configuration.

Such configurations are for example discussed in API 17B as identified above.

In an embodiment at least an uppermost part of the catenary riser section is a flexible riser section. In an embodiment the whole of the catenary riser section is a flexible riser section.

The flexible riser section is preferably an unbonded pipe flexible riser section.

In an embodiment the catenary riser section comprises two or more sub-sections which sub-sections are different from each other. Such riser section with different sub-sections is preferably a riser section of a transportation line suitably for transportation of fluid.

The two or more subsections advantageously comprise two or more different subsections of unbonded flexible pipe(s).

In an embodiment the two or more subsections comprise at least one sub-section of an unbonded flexible pipe and at least one sub-section of a steel pipe.

The skilled person will appreciate that any combinations of sub-sections can be applied adapted for the specific application.

The transportation line comprises a connecting portion arranged between the lowermost end of the top site section and the uppermost end of the riser section.

The connection portion is pivotally connected to the floating unit. Advantageously the connection portion is connected to the floating in a unit ball joint. Thereby the risk of torque and fatigue is even further reduced.

The connection portion is preferably connected to the floating unit such that at least a major part of pulling force from the riser section is born by the connection to the floating unit; thereby the top site section of the transportation line is essentially not subjected to pulling forces from the weight of the riser section. Simultaneously the pivotal connection ensures reduced stress in the uppermost end of the riser section. In particular it has been found that the pivotal connection is capable of alleviating loadings on the transportation line caused by the various motions of the floating unit including displacement motions (heave, sway, drift, and/or surge) and angular motions (yaw, pitch, and/or roll). In particular it is surprising that loading due to heave motions of the floating unit can be alleviated by the offshore top site system of the invention.

The connection portion is advantageously pivotally connected to the floating unit such that at least a major part of pulling force from the riser section is borne by the connection to the floating unit, preferably at least about 75%, such as at least about 85%, such as at least about 95%, such as essentially all of weight of the catenary riser section determined in water is transferred to the floating unit via the connection portion.

The weight is transferred to the floating unit via the connection portion in form of pulling force.

The terms borne and alleviated in connection with the weight of the catenary section are used interchangeable to mean that the force generated by the weight in question is transferred to the floating unit.

The connection portion is preferably substantially rigid. In order to ensure a very stable and strong connection it is desired that the connection portion comprises a metal tube section either provided by or comprising an end fitting of a transportation line section, an armor part of a flexible transportation line section which armor part is less flexible than adjacent armor parts and/or an intermediate tube section. Generally it is desired that the connection portion is a portion of the transportation line which is more rigid than the uppermost end of the catenary riser section and the lowermost end of the top site section.

In an embodiment the connection portion is a portion of the transportation line which has a stiffness which is at least about 50% higher than the stiffness of the uppermost end of the catenary riser section and the lowermost end of the top site section.

In an embodiment the connecting portion is arranged within the vertical floating unit zone, thereby a more stable system is obtained where risk of applying torsional forces to the floating unit is reduced of fully avoided even where the catenary is very heavy.

In an embodiment the connecting portion is arranged outside the vertical floating unit zone. In this embodiment the floating unit should advantageous be relatively large in perimeter (the outer periphery of the bottom) to ensure a high stability since the catenary may otherwise apply torsional forces to the floating unit. Alternatively or additionally the offshore top site system can comprise a plurality of catenary riser sections arranged oppositely to each other in a balanced configuration.

In an embodiment the floating unit has an outer frame defining the outer periphery of the bottom, wherein the connection portion is pivotally connected to the floating unit at its outer frame. Advantageously the floating unit is a vessel and the outer frame is constituted by at least a part of a bow and/or a part of a stern of the vessel.

The top site system of the invention is in particular advantageous where the riser section has a length of at least about 2000 m. Preferably the catenary riser section has a length of at least about 2500 m.

It should be emphasized that the term "comprises/comprising" when used herein is to be interpreted as an open term, i.e. it should be taken to specify the presence of specifically stated feature(s), such as element(s), unit(s), integer(s), step(s) component(s) and combination(s) thereof, but does not preclude the presence or addition of one or more other stated features.

The term 'seabed' is generally used to denote the subsea floor.

The term "water line" means the water line at still water. Unless specifically mentioned all distances and determinations in relation to the water line are made at still water at average water level.

The term "horizontal" means in a plane parallel to the water line and in the same way "horizontal plan" means a plane parallel to the sea water at still water and the term "horizontal direction" means a direction in the horizontal plan.

The term above means in a plan vertically above, where vertical direction is perpendicular to horizontal plan. In the same way the terms upper, uppermost as well as below, lower and lowermost mean with respect to vertically plans i.e. in higher respectively lower plans.

The term "downwards" means in a direction towards a lower plan.

All sections of the transportation line and parts thereof should be interpreted to mean length sections along the length of the transportation line unless otherwise specified.

All features of the inventions including ranges and preferred ranges can be combined in various ways within the scope of the invention, unless there are specific reasons for not to combine such features.

In an embodiment the connecting portion is arranged below the bottom of the floating unit. In order to ensure safe control of the connection portion and in order to keep the top site section as short as possible, the distance between the bottom of the floating unit should preferably be kept relatively short. Thereby it will also make it simpler to install. In an embodiment the distance from the connection portion to the bottom of the floating unit is up to about 25 m, such as up to about 15 m, such as up to about 10 m. More preferably the preferable distance from the connection portion to the bottom of the floating unit is up to about 5 m.

The connection portion can be connected to the floating unit by a tether line directly to the bottom of the floating unit or to any other part of the floating unit which would result in the desired position of the connection portion.

In an embodiment the connecting portion is arranged above the bottom of the floating unit. In this embodiment, the catenary riser section extends through an opening in the bottom of the floating unit and the connection portion is preferably pivotally connected to the floating unit by being connected to an internal bearing structure of the floating unit.

In an embodiment of the invention the top site section and the catenary riser section of the transportation line are separate sections which are connected to each other.

In an embodiment the catenary riser section and the top site section of the transportation line are connected to each other via respective end-fittings and optionally with an intermediate transition piece, e.g. shaped as a metal tube section and/or a pull-head. Preferably at least one of the respective end-fittings or the optional transition piece provides the connection portion pivotally connected to the floating unit.

Where the top site section and the catenary riser section of the transportation line are separate sections which are connected to each other it is generally desired that the catenary riser section comprises an end-fitting at its uppermost end and the top site section comprises an end-fitting at its lowermost end and the catenary riser section and the top site section of the transportation line are connected to each other via the catenary riser section uppermost end-fitting and the top site section lowermost end-fitting.

In an embodiment the catenary riser section and the top site section is connected end-fitting to end fitting i.e. the catenary riser section uppermost end-fitting and the top site section lowermost end-fitting are directly connected to each other. Preferably one or both of the end-fittings constitute the connection portion pivotally connected to the floating unit.

In an embodiment the catenary riser section and the top site section are connected with an intermediate transition piece i.e. the catenary riser section uppermost end-fitting and the top site section lowermost end-fitting are connected to each other with a transition piece between the sections. Preferably the intermediate transition piece constitutes the connection portion which is pivotally connected to the floating unit.

The intermediated transition piece is preferably a metal tube section having a length of up to about 1 m, preferably from about 2 cm to about 50 cm, such as from about 5 cm to about 25 cm. The intermediate transition piece can for example have a pull head like structure comprising a flange or other protruding parts for being tethered pivotally to the floating unit.

In an embodiment of the invention the catenary riser section and the top site section are connected with an intermediate transition piece and the intermediated transition piece constitutes the connection portion which is pivotally connected to the floating unit via one or more flexible or rigid tethering lines, where the pivotal connection between the tethering line(s) allows torsion movements of the transition piece in at least one direction, preferably in two or even three directions with perpendicular torsion axis'.

In an embodiment of the invention the catenary riser section and the top site section are connected with an intermediate transition piece and the intermediated transition piece constitutes the connection portion which is pivotally connected to the floating unit via one or more flexible or rigid tethering lines, where the pivotal connection between the tethering line(s) allows tilting movements of the transition piece in at least one direction, preferably in two or even three directions with perpendicular tilting axis'.

In an embodiment of the invention the top site section and the catenary riser section of the transportation line are sections of an integrated part i.e. with no terminating end fitting between the top site section and the catenary riser section.

In this embodiment the catenary riser section and the top site section are for example integrated parts comprising at least one metal layer, wherein a portion of the metal layer provides the connection portion pivotally connected to the floating unit. This portion of the metal layer is preferably more rigid against bending i.e. it has a higher bending stiffness than the adjacent parts of the metal layer where the metal layer is part of respectively the top site section and the composite armored riser section.

In an embodiment the catenary riser section and the top site section are sections of a continuing flexible pipe. The flexible pipe comprises at least one inner sealing sheath and at least one armor layer comprising helically wound elongate metal elements surrounding the inner sealing sheath and the connection portion is provided by a section of the armor layer. To ensure that the section of the armor layer providing the connection portion has a higher bending stiffness than the armor layer adjacent thereto, the helically wound elongate metal elements are preferably fixed such that the flexibility of the armor layer at the connection portion is reduced, preferably such that the connection portion becomes essentially stiff.

For example the helically wound elongate metal elements can advantageously be fixed mechanically or using a fixing material, such as epoxy, to provide the connection portion. The length of the connection portion is preferably up to about 1 m, preferably from about 2 cm to about 50 cm, such as from about 5 cm to about 25 cm.

The offshore top site system of the invention can be positioned using any position methods such that it is generally known in the art. The purpose of the positioning is to keep the floating unit stable on the sea surface when subjected to environmental forces. For the specific floating unit the position is usually selected such that the environmental forces provide the lowest forces possible to the floating unit.

In an embodiment the floating unit is moored by one or more mooring lines, e.g. to provide a weathervaning floating unit or a spread moored floating unit.

The mooring system is preferably arranged and designed to comply with the standard API RP 2SK and/or API RP 2FPS.

In an embodiment the floating unit is positioned using a dynamic positioning system.

Dynamic positioning systems for vessels are well known and are generally applied to keep the vessel within a specified position and heading limits either alone or in combination with mooring. Such dynamic positioning systems are for example sold by Kongsberg Maritime Norway.

Usually a vessel is positioned such that it can have an optimal position with respect to wind, water current and/or waves to be as stable on the water as possible. The most optimal position for a vessel to be positioned is generally to be arranged such that the vessel as often as possible is facing the wind.

The offshore top site system of the invention is in particular advantageous where the floating unit is a vessel. As mentioned above, even vessels which initially were not adapted for use in an offshore top site system can in a simple and cost effective way be modified to be used in the offshore top site system of the invention.

In an embodiment of the invention the floating unit is a vessel having a hull with a bow and a stern and preferably a keel with a protruding part.

The hull is the watertight body of a ship. The term "hull structure" is herein applied to mean the bearing hull structure.

The bow is the front most part of the hull, and the stern is the rear-most part of the hull. The term 'vessel waterline' designates an imaginary line circumscribing the hull that matches the surface of the water when the hull is not moving and the vessel is without load beyond its own weight.

The term 'midships' is herein applied to designate the vessel midpoint determined as the midpoint of the length from the forward most point of the waterline measured in profile to the stern-most point of the waterline.

The keel is a spine of the hull and runs generally along the midline of the hull from the bow to the stern. The keel preferably protrudes downwards from the hull in at least a part of its length from the bow to the stern.

The vessel defines a waterline vertical floating unit zone which is lying within the vertical floating unit zone and defined by the part of the bottom of the vessel lying below the vessel waterline. The part of the bottom of the vessel lying below the vessel waterline and facing downwards has an outer periphery defining a horizontal periphery of the waterline vertical floating unit zone.

In a preferred embodiment the connection portion of the transportation line is arranged within the waterline vertical floating unit zone thereby providing additional security against damaging the transportation line by collision.

In a very advantageous embodiment the connection portion is pivotally connected to the vessel by being connected to the hull. This connection can be provided in a very simple manner and without any specific modifications of the vessel. The connection to the hull is preferably provided at a connection point or several connection points, which connection point(s) is/are relatively close to the midline of the hull to thereby provide that the pulling force applied to the vessel is near the midline of the hull, e.g. up to 1 m, such as up to 50 cm, such as immediately adjacent to the midline of the hull.

If there are several transportation lines with respective connection portions, these connections can advantageously be provided at connection points to the hull which are symmetrically arranged with the midline of the hull as symmetry line.

In an embodiment the connection portion is pivotally connected to the vessel by being connected to the keel. The keel provides a very good connection point for connection of the connection portion.

In an embodiment the connection portion is pivotally connected to the vessel by being connected to the bow. Since the vessel most often will be arranged such that the vessel as often as possible is facing the wind, the connection to the bow may provide a good cooling effect to the transportation line and accordingly such connection point can be preferred when cooling is desired.

In an embodiment the vessel comprises a load support shelf connected to and protruding from the hull and the connection portion is pivotally connected to the vessel by being connected to the load support shelf. Such support shelf can in a simple manner be arranged for providing a connection point for several connection portions of respective transportation lines, thereby making it possible to add additional transportation lines, if and when required.

In an embodiment the vessel comprises an opening through the hull, the catenary riser section extends through the opening in the hull and the connection portion is pivotally connected to the floating unit by being connected to an internal bearing structure of the vessel.

The opening through the hull may for example be a hawse hole providing access to the internal bearing structure, preferably near or even adjacent to midships of the vessel.

Generally it is a more expensive solution to have the catenary riser section extending through an opening in the hull; however, fore some applications this solution may be preferred.

The connection portion is advantageously pivotally connected to the floating unit using one or more tether lines, such as flexible tether lines (e.g. cables or chains) or rigid tether lines. The pivotal connection requires in general a pivotal connection in at least one end of two ends the tether line i.e. the end where the tether line is connected to the floating unit and/or the end where tether line is connected to the connection portion.

In an embodiment the pivotal connection comprises a pivotal connection both ends of the tether line i.e. the end where the tether line is connected to the floating unit and the end where tether line is connected to the connection portion.

In an embodiment the tether line(s) is/are rigid. There a more stable and resistant connection can be applied where any potential risk of collision between transportation line and floating unit is reduced.

Advantageously and in order to provide a distributed and e.g. symmetrical pull in the connection portion, the connection portion is pivotally connected to the floating unit via at least two tether lines.

In an embodiment the connection portion is pivotally connected to the floating unit via at least one non-elongating connection.

The terms that the connection portion is pivotally connected to the floating unit via at least one non-elongating connection means that the connection portion and the floating unit can be pivotally displaced with respect to each other while the distance between the connection portion and the floating unit is fixed.

In an embodiment the connection portion is pivotally connected to the floating unit using at least one non-elongatable tether line, the non elongatable tether line is connected to the floating unit in a connection point, the distance between the connection point and the connection portion is constant when the non-elongatable tether line is straight.

The offshore top site system may comprise additional elements. Generally the offshore top site system alleviates loads in connection areas, which in practice means that even in the situation where the catenary riser section is a flexible pipe, a bending stiffener is not required. This can be very beneficial in embodiments where the fluids to be transported have relatively high temperatures, because the absence of a bending stiffener provides the possibility of increased cooling and thereby protection of the material of the catenary riser section against overheating. However, it may be desired to arrange a bell mouth to restrict the bending degree of the catenary riser section.

In an embodiment wherein the connection portion is pivotally connected to the floating unit using at least one tether line, the tether line is connected to the floating unit in a connection point, the system further comprises a bell mouth mounted to adjust the pivotal movement of the tether line. Preferably the bell mouth is mounted immediately adjacent to the connection point.

In an advantageous embodiment, the system further comprises a hanging support structure arranged below the bottom of the floating unit. The connection portion is pivotally connected to the floating unit via the hanging support structure. Advantageously the hanging support structure is also pivotally connected to the floating unit, preferably by a plurality of rigid tether lines.

The hanging support structure may in principle have any size and shape. Preferably the hanging support structure has a symmetrical shape. The hanging support structure can for example have a beam shaped structure.

In an embodiment two or more transportation lines comprise respective connection portions, the respective connection portions are pivotally connected to the hanging support structure. The respective connection portions are preferably connected to the hanging support structure in a symmetrical pattern.

The hanging support structure can additionally comprise one or more buoyancy elements for reducing the load on the floating unit.

Buoyancy modules are generally rather expensive and often they will need to be replaced due to accidentally damage or after a few numbers of years. Therefore it is advantageous to use only few buoyancy modules or none at all.

In an embodiment at most about 25% of the weight of the catenary section is borne by buoyancy module(s), preferably at most about 10% of the weight of the catenary section is borne by buoyancy module(s), more preferably the catenary section is free of any buoyancy module.

In an embodiment the catenary section is a free hanging catenary section extending from the connection portion to seabed, preferably without any buoyancy module.

The offshore top site system of the invention may advantageously be constructed such that at least the catenary riser section is disconnectable.

Disconnectable FPSOs for protection against hurricanes or similar are known from prior art in particular in connection with turret FPSOS e.g. as described in "Permanent versus disconnectable FPSOs" J. Marine. Sci. Appl. (2009).

The offshore top site system of the invention can advantageously be constructed to be a disconnectable FPSO, where the offshore top site system comprises a hanging support structure. The disconnection(s) can be provided between the connection portion(s) and the top site section(s) and the tether line(s) between the vessel and the hanging support structure can additionally be disconnected. The top site section(s) can in a simple manner be hauled onboard. The hanging support structure can be provided with a chip for easy localization when the offshore top site system is to be re-established. The hanging support structure can, as mentioned above, also be equipped with one or more buoyancy elements to ensure that it does not sink to the seabed, but will be localized at a desired water dept.

All features of the inventions as described herein, including ranges and preferred ranges can be combined in various ways within the scope of the invention, unless there are specific reasons not to combine such features.

BRIEF DESCRIPTION OF DRAWINGS

The invention will be explained more fully below in connection with a preferred embodiment and with reference to the drawings in which.

Figure 1:
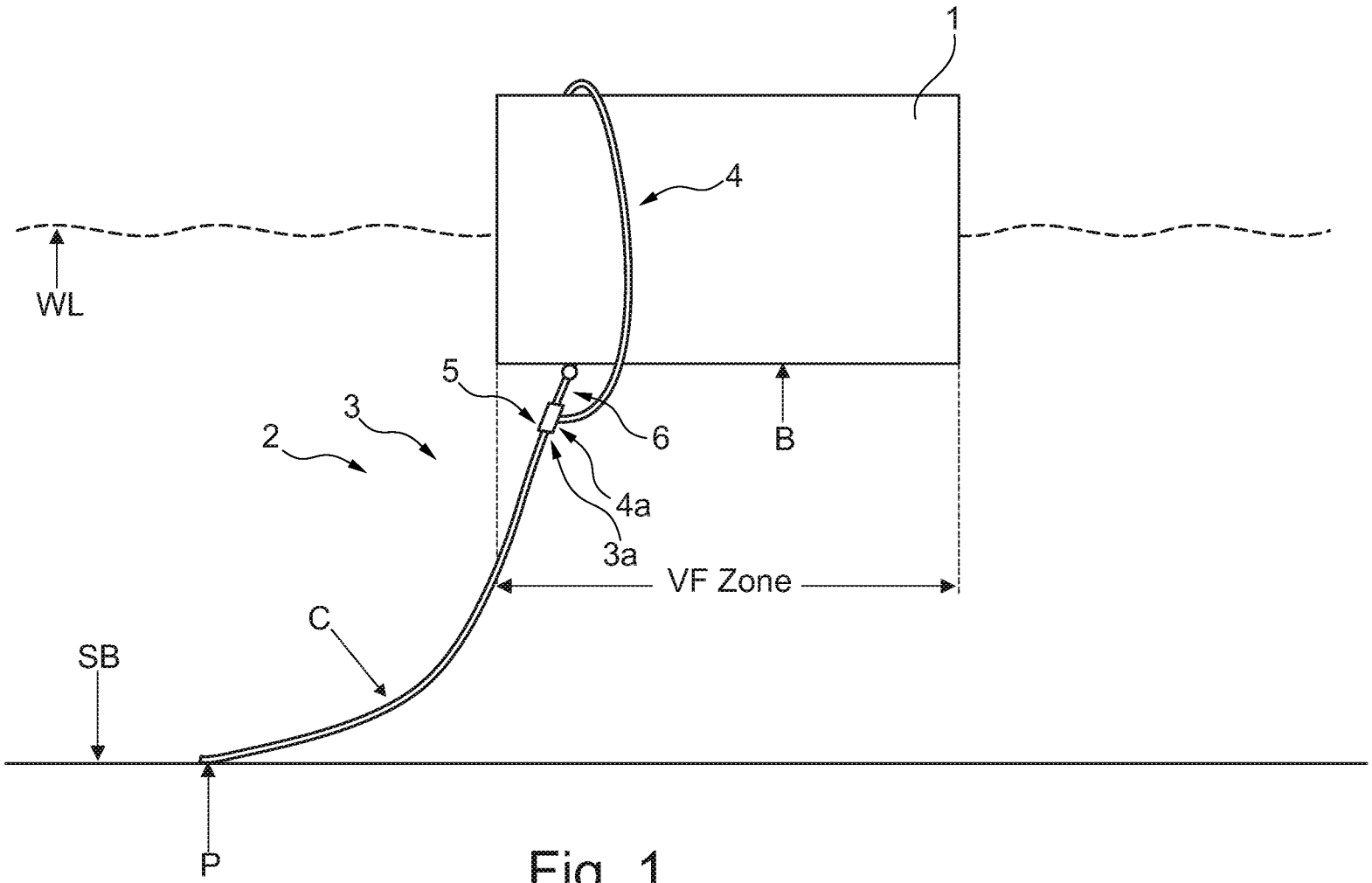
FIG. 1 is a schematic side view of an offshore top site system of the invention comprising a not shown subsea facility, a floating unit arranged above the subsea facility and a transportation line with a top site section, a catenary riser section and a connection portion pivotally connected to the floating unit.

The offshore top site system shown in FIG. 1 comprises a not shown subsea facility, a floating unit 1 arranged above the subsea facility and at least one transportation line 2 extending between the not shown subsea facility and the floating unit 1.

The transportation line 2 comprises a catenary riser section 3 with an uppermost end 3*a* and a top site section 4 with a lowermost end 4*a* and the catenary riser section 3 and the top site section 4 are in flow connection with each other.

The floating unit 1 is floating at the water line WL.

As it can be seen the catenary riser section 3 extends downwards towards the seabed SB with a catenary curve C and touches the seabed SB in a touch down point P. The catenary riser section 3 leads to the not shown subsea facility which as mentioned above can be e.g. a well or a connection to another pipeline.

The top site section 4 extends upwards e.g. towards a not shown tank or similar onboard the floating unit.

The transportation line 2 further comprises a connecting portion 5 connecting the uppermost end 3*a* of the catenary riser section 3 with the lowermost end 4*a* of the top site section 4.

The floating unit 1 has a bottom B facing downwards and an outer periphery of the bottom defining a horizontal periphery—marked with dotted lines—of a vertical floating unit zone VF Zone. The connecting portion 5 is arranged within the vertical floating unit zone VF Zone.

The connection portion 5 is pivotally connected directly to the floating unit via a tether line 6, such that at least a major part of pulling force from the riser section is alleviated by the connection to the floating unit. The pivotally connection implies that both the connection between the tether line 6 and the floating unit 1 as well as the connection between the tether line 6 and the connection portion 5 are pivotal.

Figure 2:
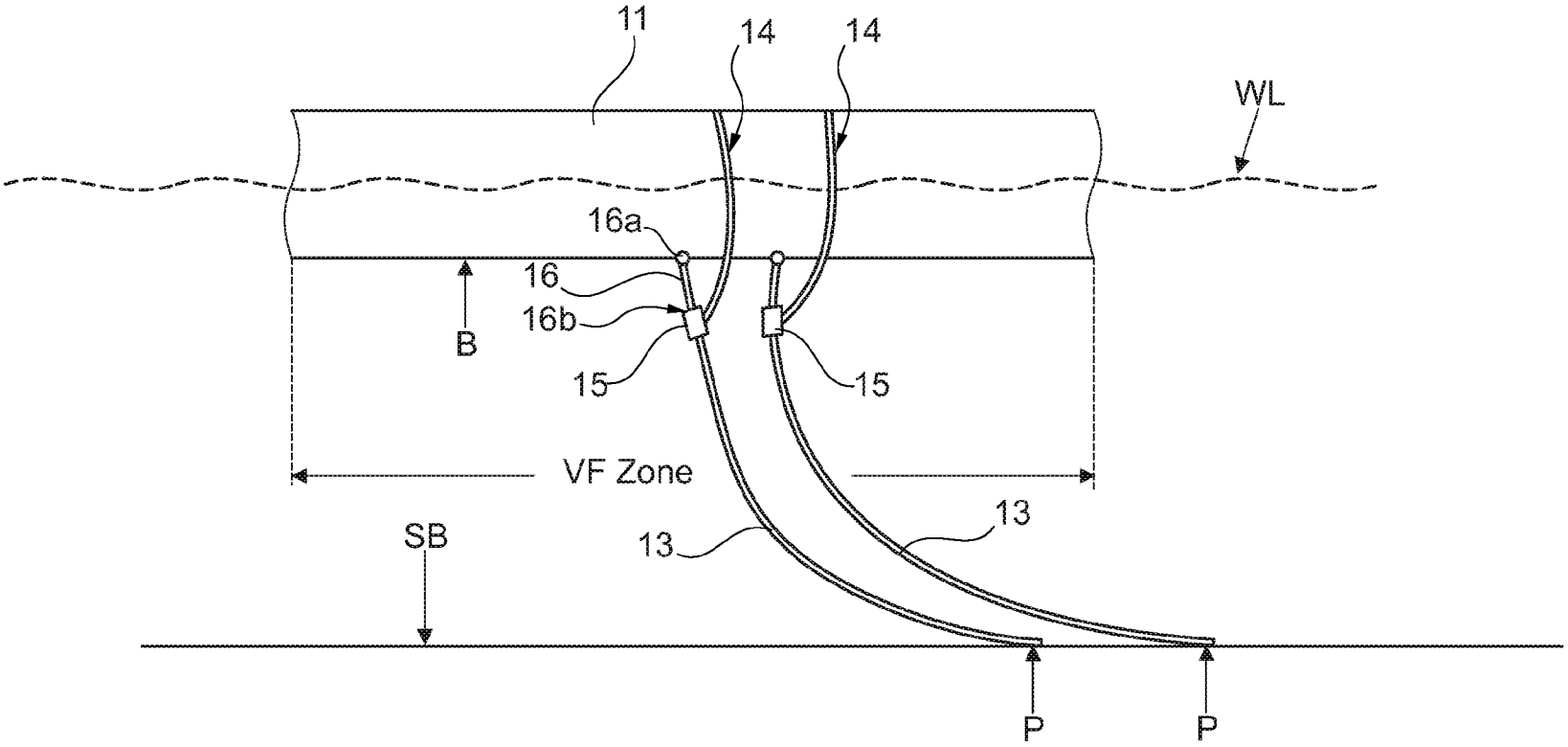
FIG. 2 is a schematic side view of another offshore top site system of the invention comprising two or more transportation lines and where the floating unit is a vessel.

The offshore top site system shown in FIG. 2 comprises a floating unit in the form of a vessel 11 floating at the water line WL and a plurality of transportation lines extending between a not shown subsea facility at the seabed SB and the vessel 11.

Each transportation line comprises a catenary riser section 13 and a top site section 14 in flow connection with each other.

As it can be seen the catenary riser sections 13 extend downwards towards the seabed SB and touch the seabed SB in respective touch down points P.

The top site sections 14 extend upwards e.g. towards a not shown tank or similar onboard the floating unit. Due to the construction the top site sections 14 are not subjected to any load from the weight of the connected catenary riser sections 13.

Each transportation line further comprises a connecting portion 15 connecting the catenary riser section 13 with the top site section 14.

The vessel 11 has a bottom B facing downwards and an outer periphery of the bottom defining a horizontal periphery—marked with dotted lines—of a vertical floating unit zone VF Zone. The connecting portions 15 are arranged within the vertical floating unit zone VF Zone.

The connection portion 15 is pivotally connected directly to the vessel 11 via a tether line 16, such that any pulling force from the riser section is alleviated by the connection to the vessel 11. The pivotally connection implies that the respective connections 16*a* between the tether line 16 and the vessel 11 as well as the respective connections 16*b* between the tether line 16 and the connection portion 15 are pivotal.

Figure 3:
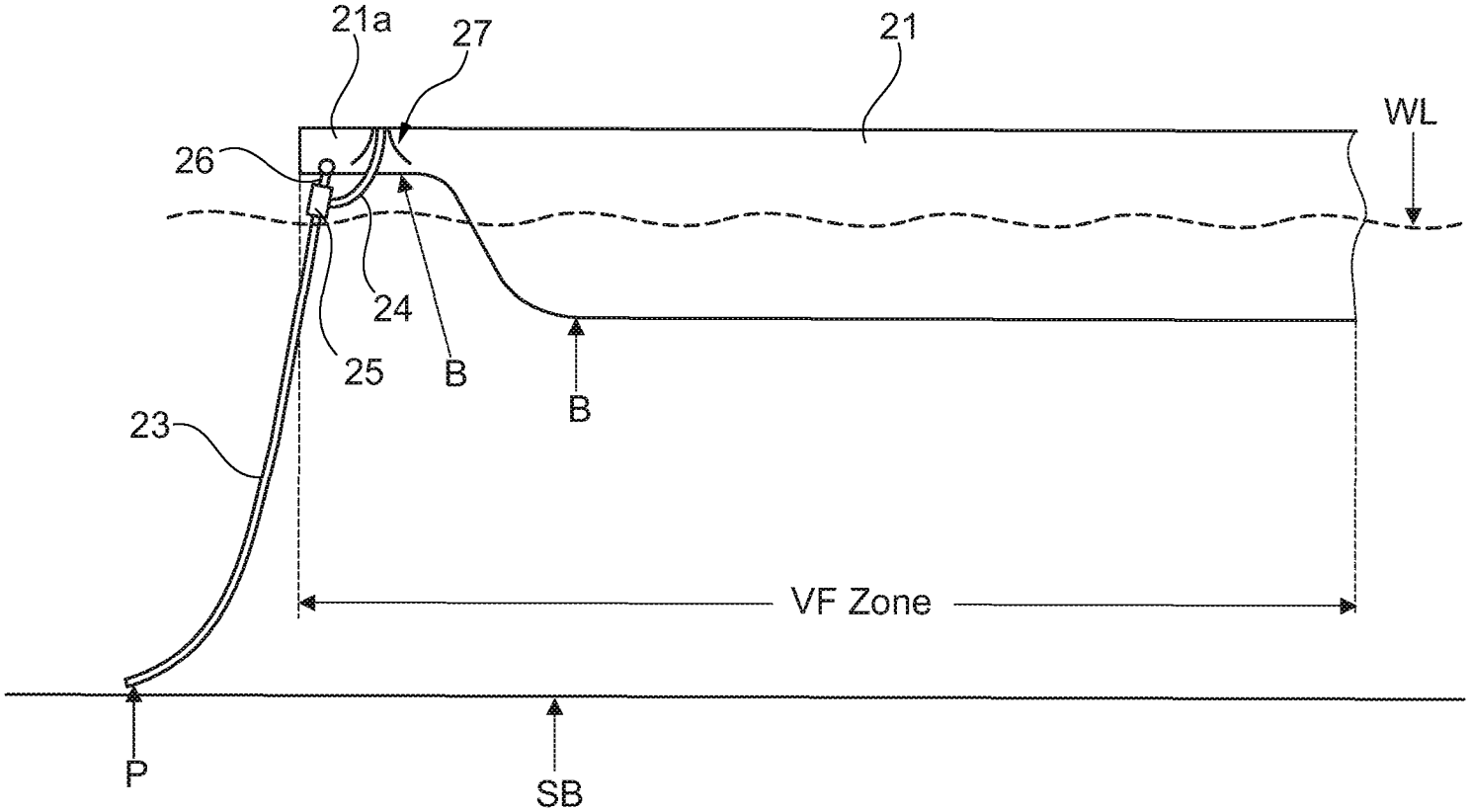
FIG. 3 is a schematic side view of a further offshore top site system of the invention where the floating unit is a vessel and the connection portion is pivotally connected to a bottom side of the bow.

The offshore top site system shown in FIG. 3 comprises a floating unit in the form of a vessel 21 floating at the water line WL and a transportation line extending between a not shown subsea facility at the seabed SB and the vessel 21.

The transportation line comprises a catenary riser section 23 and a top site section 24 in flow connection with each other.

As it can be seen the catenary riser section 23 extends downwards towards the seabed SB and touches the seabed SB in a touch down point P.

The top site section 24 extends upwards where it is guided by a bellmouth 27 and further e.g. towards a not shown tank or similar onboard the floating unit.

Such bellmouth is well known in the art and is generally applied to protect against undesired bends and movements of a flexible pipeline. Such bellmouths are generally relatively simple to install and apply and are relative low-cost equipment.

The transportation line further comprises a connecting portion 25 connecting the catenary riser section 23 with the top site section 24.

The vessel 21 comprises a forward protruding bow 21*a* and has a bottom B also including the bottom of the bow 21*a*. The bottom is facing downwards and an outer periphery of the bottom defines a horizontal periphery—marked with dotted lines—of a vertical floating unit zone VF Zone. The connecting portion 25 is arranged within the vertical floating unit zone VF Zone.

The connection portion 25 is pivotally connected directly to the bottom B of the bow 21*a* via a tether line 26, such that at least a major part of pulling force from the riser section 24 is alleviated by the connection to the vessel 21.

Figures 4A, 4B:
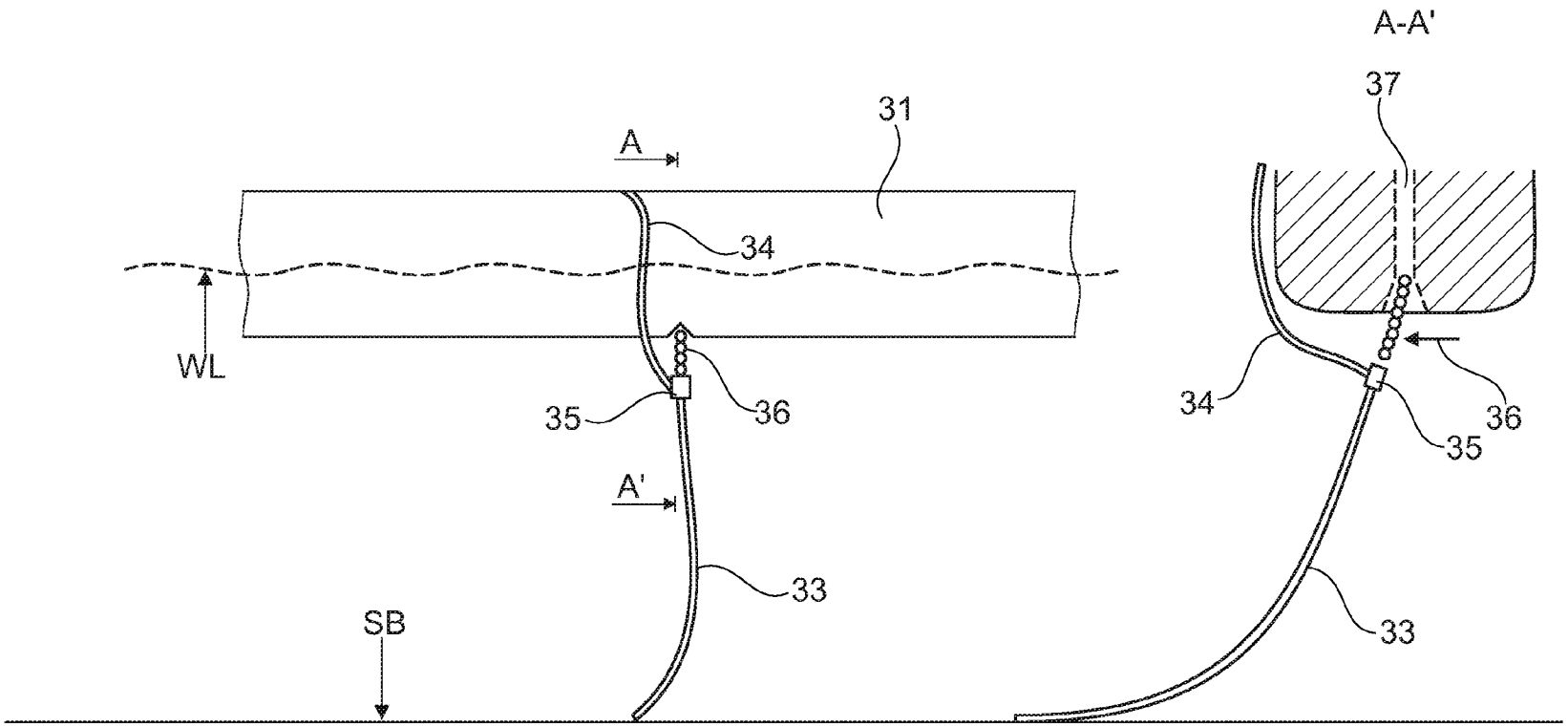
FIG. 4*a* is a schematic side view of a further offshore top site system of the invention where the floating unit is a vessel and the connection portion is pivotally connected via an opening in the bottom of the floating unit.
FIG. 4*b* is a cross-sectional view of the offshore top site system of FIG. 4*a* seen in the line A-A', where the floating unit is a vessel and the connection portion is pivotally connected via an opening in the bottom of the floating unit.

The offshore top site system shown in FIG. 4*a* comprises a floating unit in the form of a vessel 31 floating at the water line WL and a transportation line extending between a not shown subsea facility at the seabed SB and the vessel 31.

The transportation line comprises a catenary riser section 33 and a top site section 34 in flow connection with each other.

As it can be seen the catenary riser section 33 extends downwards towards the seabed SB to touch the seabed SB.

The top site section 34 extends upwards to a not shown position.

The transportation line further comprises a connecting portion 35 connecting the catenary riser section 33 with the top site section 34.

The vessel 31 comprises a bottom B facing downwards and an outer periphery of the bottom defines a horizontal periphery—marked with dotted lines—of a vertical floating unit zone VF Zone. The connecting portion 35 is arranged within the vertical floating unit zone VF Zone.

The connection portion 35 is pivotally connected to the vessel by being directly and pivotally connected to a not shown internal bearing structure of the vessel 31.

FIG. 4*b* is a cross-sectional view of the offshore top site system shown in FIG. 4*a* seen in the line A-A'. As it can be seen the connection portion 35 is pivotally connected via a tether line 36 directly to a not shown internal bearing structure of the vessel 31. The tether line—which here is in form of a chain structure—passes through the bottom B of the hull of the vessel 31 and into a passage 37, where at an appropriate position it is pivotally connected to the bearing structure of the vessel 31.

In an alternative not shown modified version the connection portion also passes through the bottom B of the hull of the vessel 31 and into the passage 37 of the vessel 31, such that the connecting portion 35 is arranged above the bottom of the floating unit and the catenary riser section 33 extends through the bottom B of the hull of the vessel 31.

Figure 5:
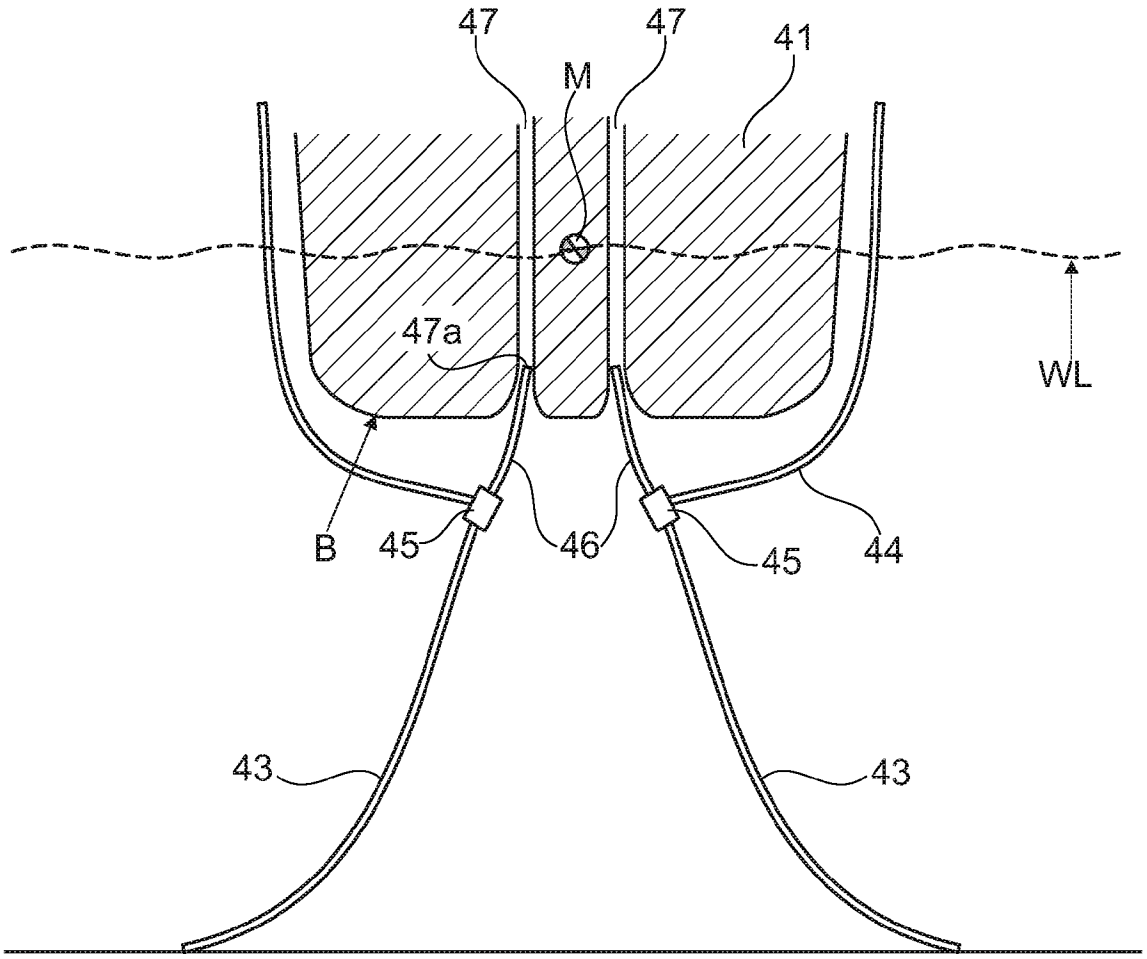
FIG. 5 is a cross-sectional view of another offshore top site system of the invention where the floating unit is a vessel and the connection portions of two or more transportation lines are pivotally connected via respective openings in the bottom of the floating unit.

FIG. 5 is a cross-sectional view of a vessel 41 of another offshore top site system of the invention where connection portions 45 of two or more transportation lines are pivotally connected via respective openings 47 in the bottom B of the vessel 41.

Each transportation line comprises a catenary riser section 43 and a top site section 44 in flow connection with each other and with the connection portion 45 arranged to connect the catenary riser section 43 with the top site section 34.

The vessel 41 has a midpoint M (midships) and the connection portions 45 are pivotally connected via tether lines 46 passing through the bottom B of the hull of the vessel 41 and into a passage 47, where the tether lines 46 at appropriate positions are pivotally connected to the bearing structure of the vessel 41. Preferably the tether lines 46 are pivotally connected to the bearing structure of the vessel 45 as close as possible to the midpoint M, because this will result in that the lowest possible amount of stress is transferred to the connection points and thereby to the transporting lines.

Figure 6:
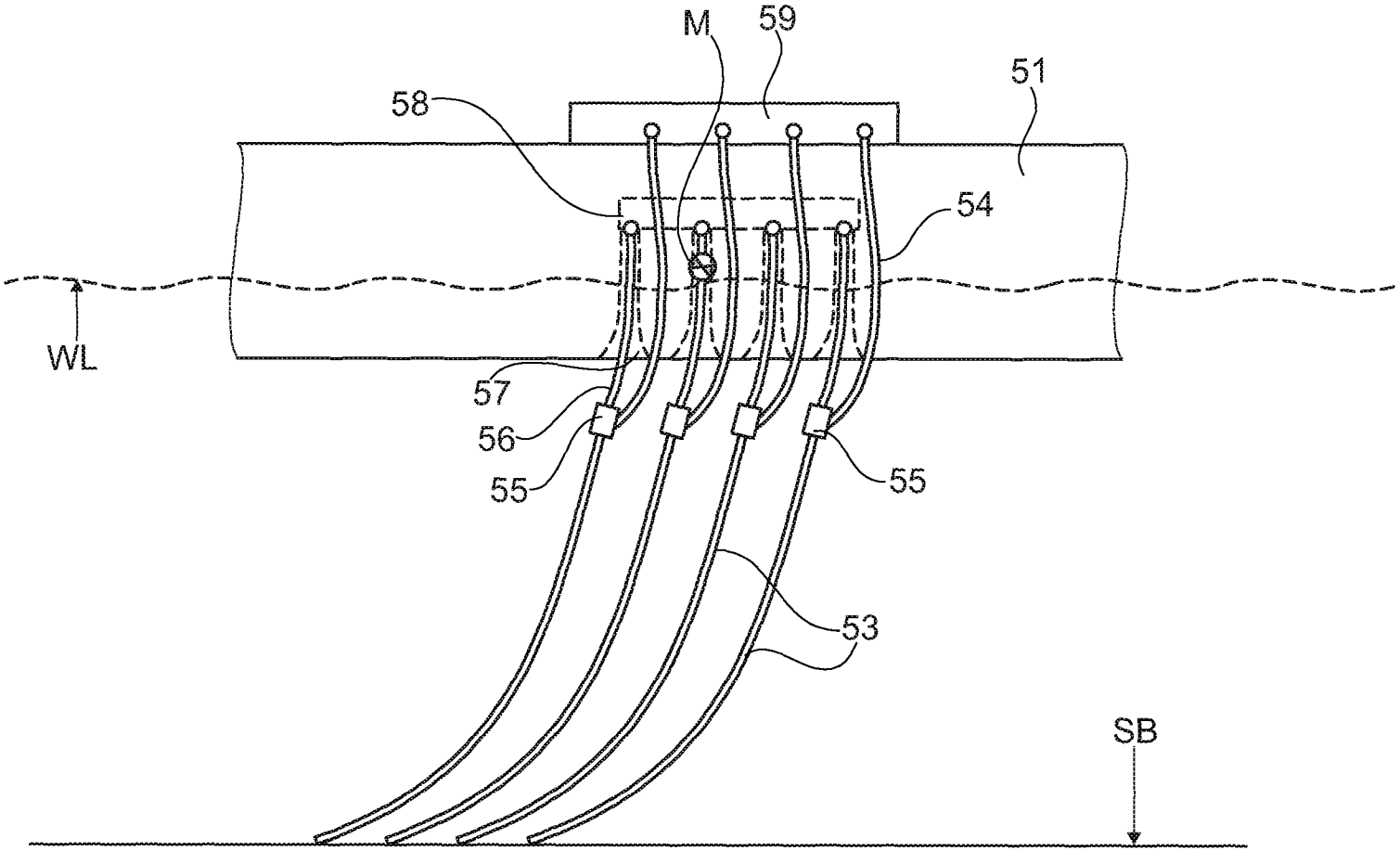
FIG. 6 is a schematic side view of a further offshore top site system of the invention where the floating unit is a vessel and connection portions of a plurality of transportation lines are pivotally connected via respective openings in the bottom of the floating unit.

FIG. 6 shows an offshore top site system of the invention comprising a floating vessel 51 floating at the water line WL and a plurality of transportation lines extending between a not shown subsea facility at the seabed SB and the vessel 51.

Each transportation line comprises a catenary riser section 53 and a top site section 54 (jumper) in flow connection with each other.

The vessel 51 comprises a jumper shelve structure 59 arranged to support and guide the top site sections 54 e.g. towards a not shown tank or similar onboard the vessel 51.

Each transportation line further comprises a connecting portion 55 connecting the catenary riser section 53 with the top site section 54.

The vessel 51 has a bottom B facing downwards and the connecting portions 55 are arranged below the bottom B of the vessel 51.

The connection portion 55 is pivotally connected via tether lines 56 which pass through the bottom B of the hull of the vessel 51 and into passages 57, where they are connected to a beam structure 58 near the midpoint M of the vessel 51. The beam structure 58 is arranged along the midline of the hull from the bow to the stern and forms part of the bearing structure of the vessel 51.

Figures 7A, 7B:
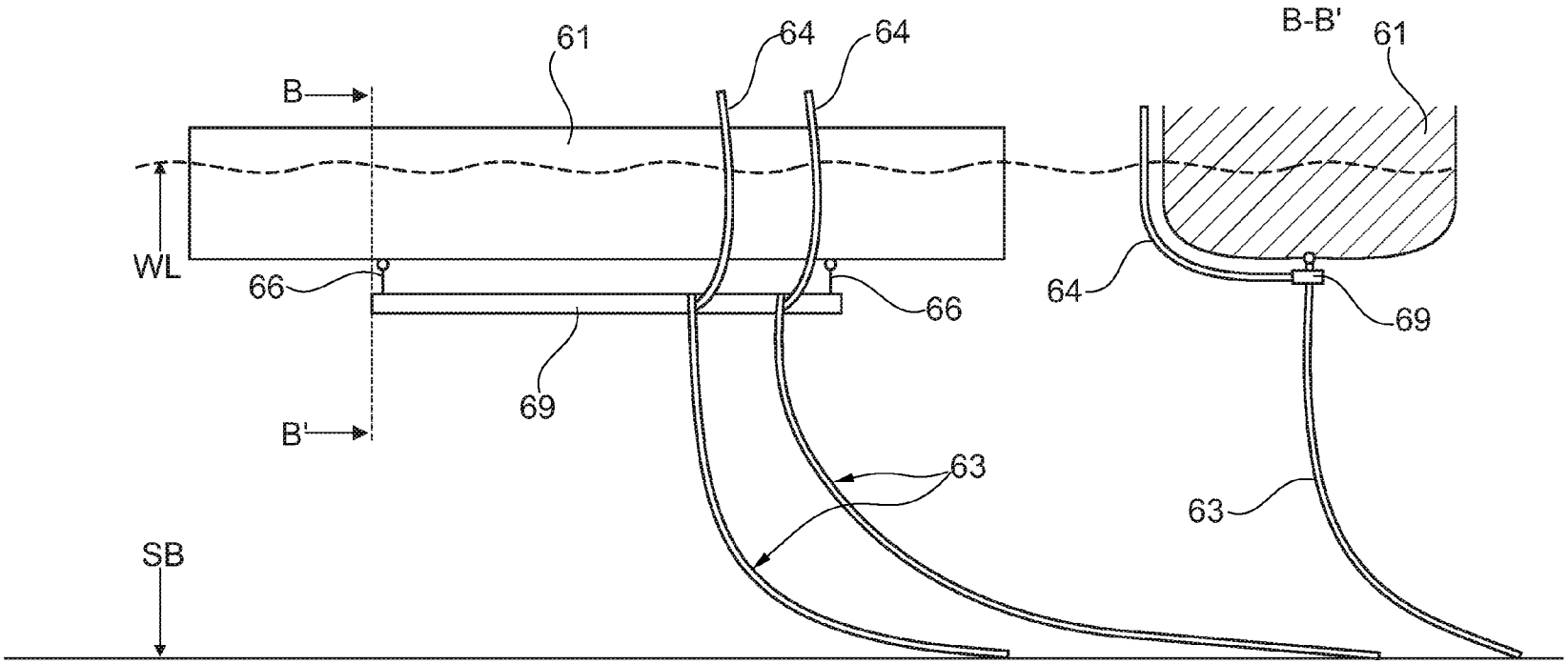
FIG. 7*a* is a schematic side view of a further offshore top site system of the invention where the floating unit is a vessel and the connection portions of transportation lines are pivotally connected to a hanging support structure which is pivotally connected to the vessel.
FIG. 7*b* is a cross-sectional view of the offshore top site system of FIG. 7*a* seen in the line B-B'.

FIG. 7*a* and FIG. 7*b* show an offshore top site system of the invention comprising a floating vessel 61 floating at the water line WL and a plurality of transportation lines extending between a not shown subsea facility at the seabed SB and the vessel 61.

Each transportation line comprises a catenary riser section 63 and a top site section 64 (jumper) in flow connection with each other.

Each transportation line further comprises a not shown connecting portion 65 connecting the catenary riser section 63 with the top site section 64.

The offshore top site system of further comprises a hanging support structure 69 which is pivotally connected to the vessel 61 via tether lines 66. The hanging support structure 69 has a beam like structure and is arranged along the midline of the hull from the bow to the stern of the vessel 61

The connection portions connecting the respective catenary riser sections 63 and top site sections 64 are pivotally connected to the hanging support structure 69.

Figure 8:
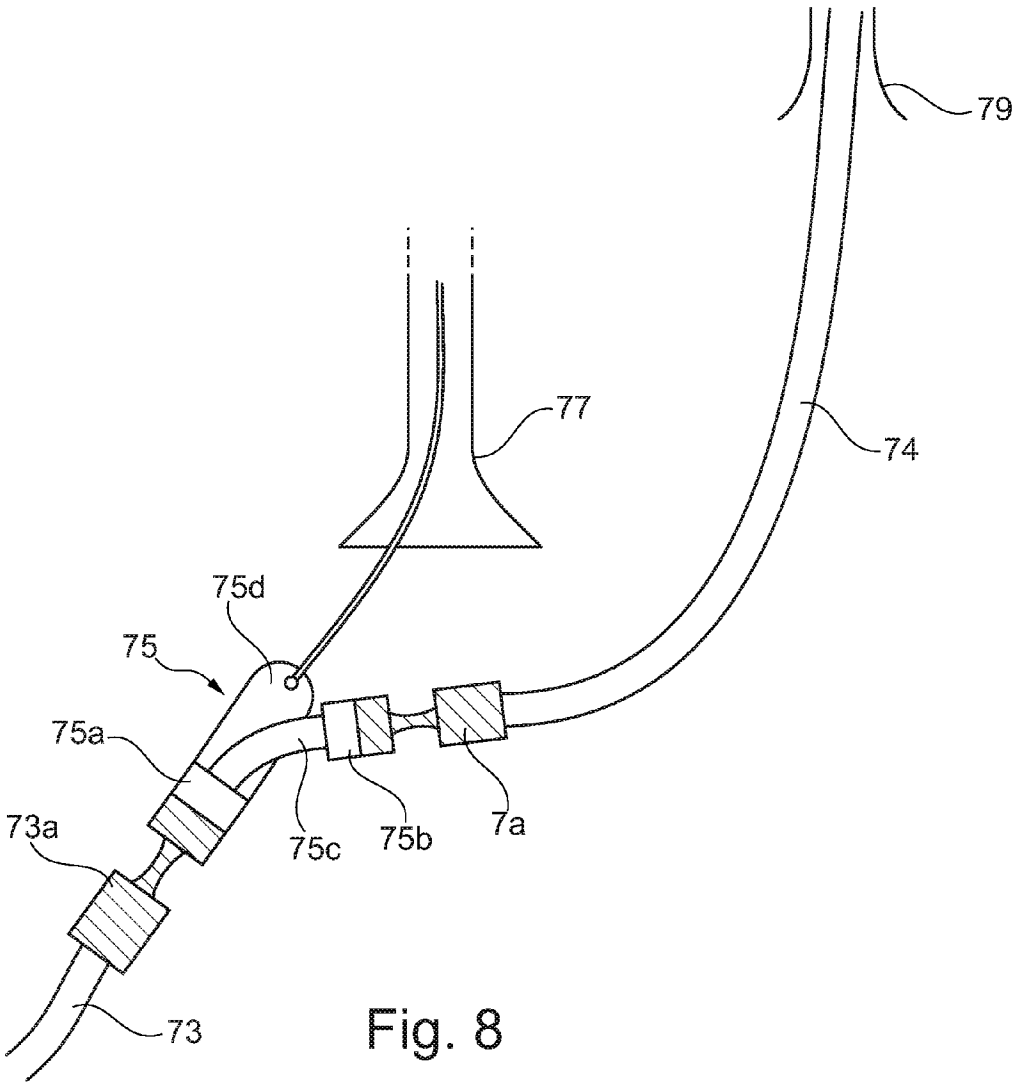
FIG. 8 is a schematic side view of a part of a transportation line comprising the connection portion as well as a part of the top site section and the catenary riser section.

FIG. 8 shows a connection portion in the form of an intermediate transition piece 75 connecting a top site section 74 and a catenary riser section 73 of a transportation line. The top site section 74 comprises a lowermost end 74*a* in the form of an end fitting and the catenary riser section 73 comprises an uppermost end 73*a* also in the form of an end fitting.

The intermediate transition piece 75 comprises a first end 75*a* fluidically connected to the uppermost end 73*a* of the catenary riser section 73 and a second end 75*b* fluidically connected to the lowermost end 74*a* of the top site section 74. The intermediate transition piece 75 further comprises a rigid mid section 75*c* and a pull-head 75*d*. A tether line is pivotally connecting the pull-heal 75*d* to a not shown floating unit. The tether line is guided to the floating unit via a bellmouth 77. The top site section 74 extends upward to a not shown position also guided by a bellmouth 79.

Figure 9:
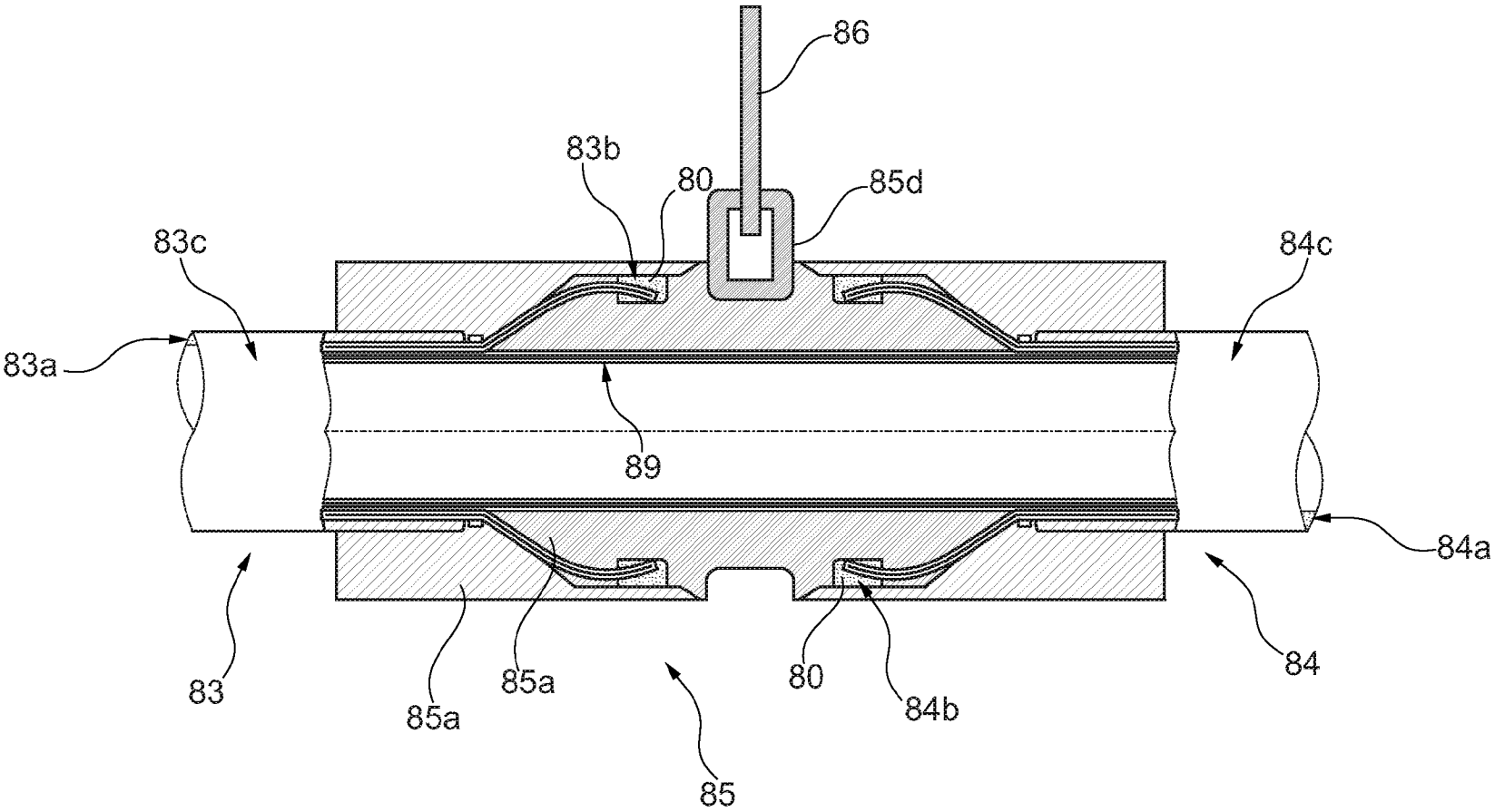
FIG. 9 is a schematic side view of a transportation line comprising the connection portion and where the top site section and the catenary riser section are integrated parts.

FIG. 9 shows a connection portion 85 of an embodiment where the catenary riser section 83 and the top site section 84 are integrated parts.

The catenary riser section 83 and the top site section 84 each comprise a plurality of layers 83*a*, 84*a* e.g. such as the unbonded flexible pipes described in "Recommended Practice for Flexible Pipe", ANSI/API 17 B, fourth Edition, July 2008, and the standard "Specification for Unbonded Flexible Pipe", ANSI/API 17J, Third edition, July 2008.

The connection portion 85 is composed of metal elements 85*a* and one or more of the layers 83*a*, 84*a* of each of the catenary riser section 83 and the top site section 84. One or more of the outermost layers, such as an outer sheath 83*c*, 84*c* and a tensile armor layer 83*b*, 84*b* are terminated in the connection portion 85. As seen the respective tensile armor layers 83*b*, 84*b* are terminated by being fixed using a fixing cement 80 such as epoxy.

The remaining layers 89 of the catenary riser section 83 and the top site section 84 pass through the connection portion 85.

The connection portion 85 further comprises a flange 85*d* pivotally connected to a tether line 86 which again is pivotally connected to a not shown floating unit.

Figure 10:
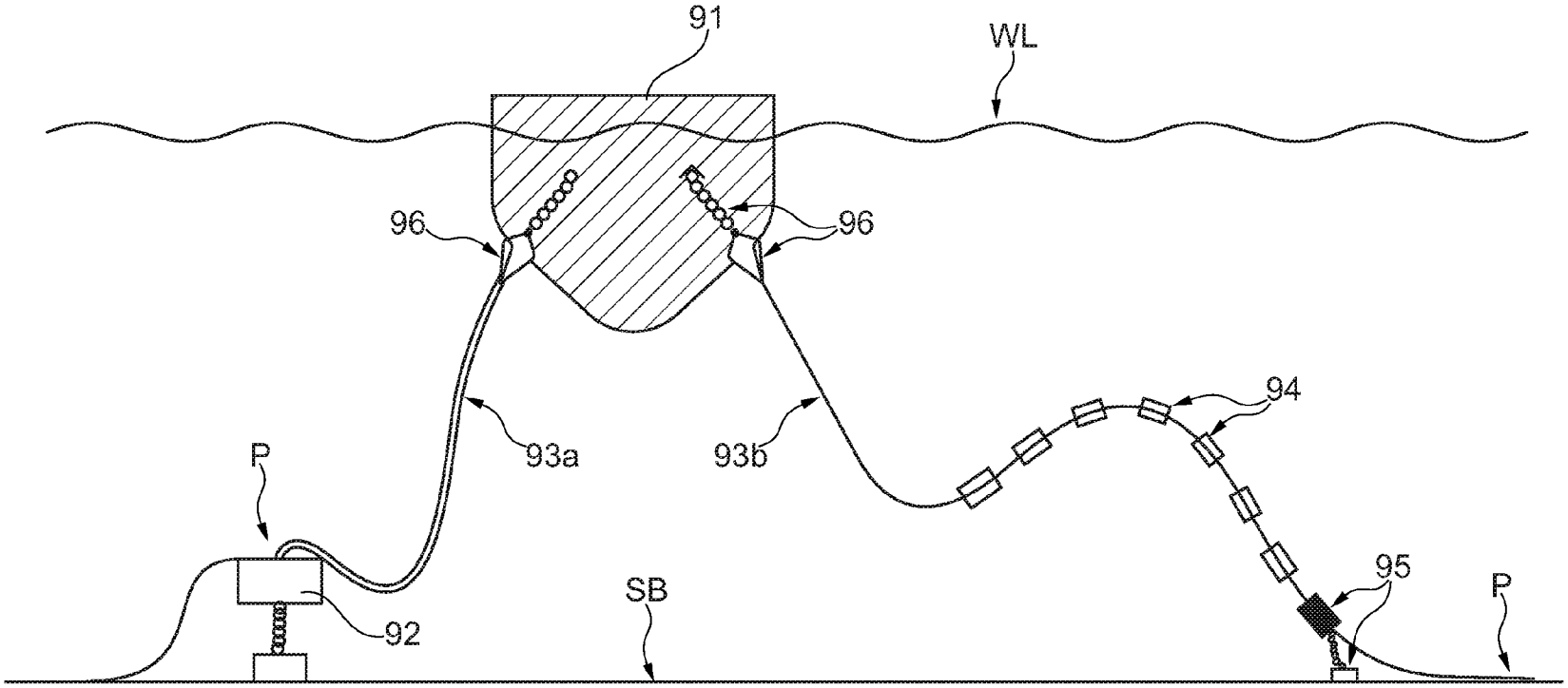
FIG. 10 is a schematic side view of a further offshore top site system of the invention where the floating unit is a vessel and comprising a transporting line where the catenary riser section is supported by a plurality of buoyancy modules.

The offshore top site system shown in FIG. 10 comprises at least one not shown subsea facility, a floating unit 91 floating at the water line WL above the subsea facility and two transporting lines comprising catenary riser sections 93*a*, 93*b* and with not shown top site sections.

The catenary riser sections 93*a*, 93*b* are pivotally connected to the floating unit 91 via their connection portions and tether lines 96.

The catenary riser section 93*a* extends downwards towards the seabed SB with a catenary curve and touches a subsea structure 92 in a touch down point P from where the transportation line leads further to a subsea facility.

The catenary riser section 93*b* extends downwards towards the seabed SB with a catenary curve and touches the seabed SB in a touch down point P from where the transportation line leads further to a subsea facility. The catenary riser section 93*b* comprises a plurality of buoyancy modules 94, which bears up to about 25% of the weight of the catenary riser section 93*b*.

The catenary riser section 93*b* is anchored to the seabed via an anchor 95 e.g. comprising a dead-man tethered to a clamp fixed to the catenary riser section 93*b*.

Figures 11A, 11B:
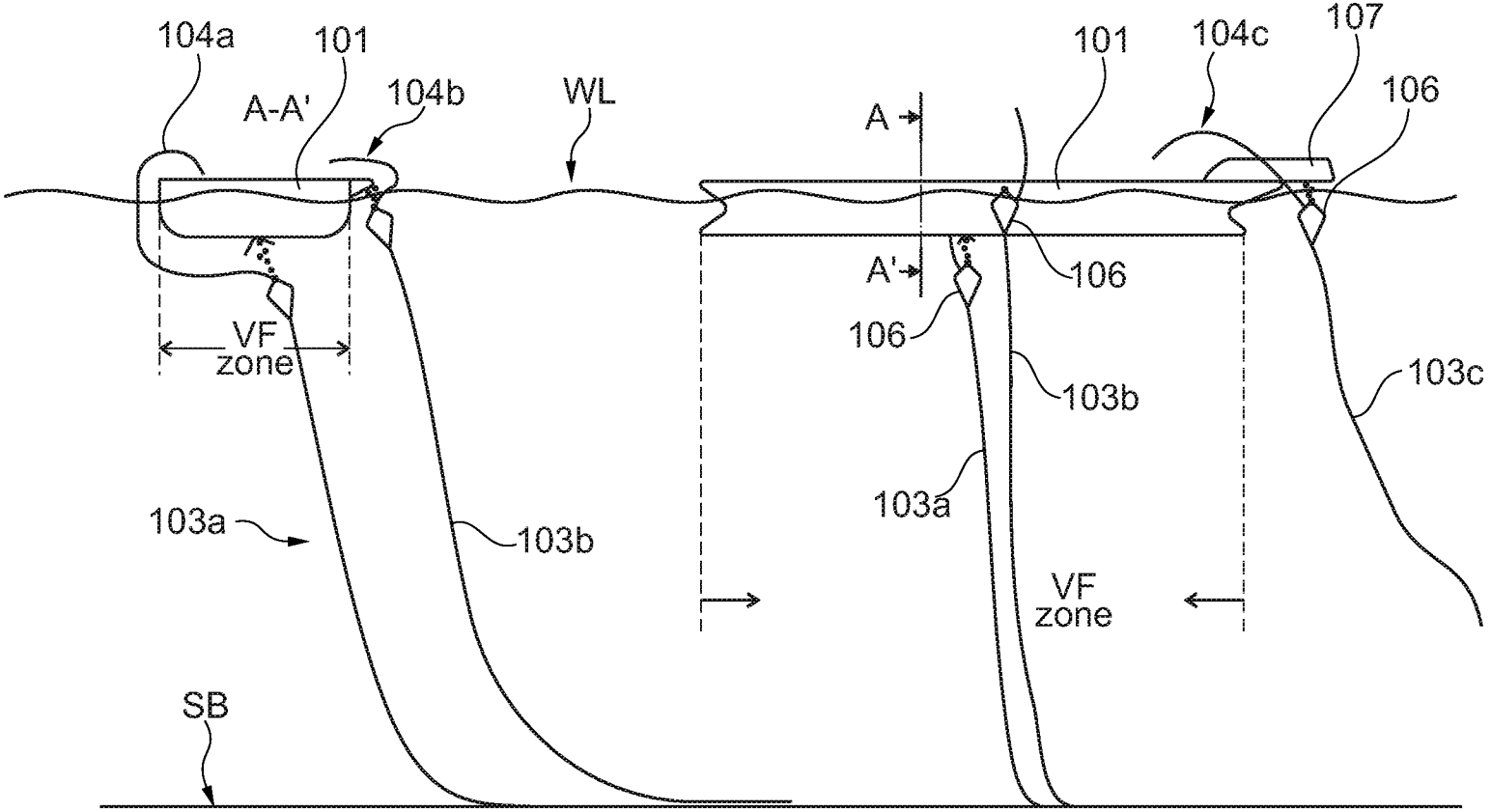
FIG. 11*a* is a schematic side view of an offshore top site system of the invention comprising of transportation lines outside the VF zone.
FIG. 11*b* is a cross-sectional view of the offshore top site system of FIG. 7*a* seen in the line A-A'.

The offshore top site system shown in FIGS. 11*a* and 11*b* comprises a floating unit 101 floating at the water line WL a number of transporting lines comprising catenary riser sections 103*a*, 103*b*, 103*c* and with top site sections 104*a*, 104*b*, 104*c*.

The catenary riser sections 103*a*, 103*b*, 103*c* are pivotally connected to the floating unit 101 via their connection portions and tether lines 106.

The catenary riser section 103*a* is pivotally connected to the floating unit 101 with in the vertical floating unit zone VF Zone.

The catenary riser section 103*b* is pivotally connected to the floating unit 101 outside the vertical floating unit zone VF Zone in that it is connected at a periphery of the floating unit 101.

The catenary riser section 103*c* is pivotally connected to the floating unit 101 outside the vertical floating unit zone VF Zone in that it is connected at a hang-off structure 107 connected to the floating unit 101.

Some preferred embodiments have been shown in the foregoing, but it should be stressed that the invention is not limited to these, but may be embodied in other ways within the subject-matter defined in the following claims.

What is claimed is:

1. An offshore top site system comprising a floating unit configured to float at a water line and at least one transportation line extending from the floating unit, the floating unit has a bottom facing downwards and an outer periphery of the bottom defining a horizontal periphery of a vertical floating unit zone, the transportation line comprises a catenary riser section with an uppermost end and a top site section with a lowermost end, the catenary riser section and the top site section being in flow connection with each other, the catenary riser section has a length of at least about 1500 m, the transportation line further comprises a connection portion arranged between the top site section and the uppermost end of the riser section, the connection portion being pivotally connected to the floating unit, such that at least a major part of pulling force from the riser section is borne by the connection portion, wherein the connection portion between the uppermost end of the catenary riser section and the lowermost end of the top site section comprises a rigid section that is substantially nonlinear with respect to longitudinal axes of the catenary riser section and the top site section.

2. The offshore top site system as claimed in claim 1, wherein at least about 75% of a weight of the catenary riser section determined in water is transferred to the floating unit via the connection portion.

3. The offshore top site system as claimed in claim 1, wherein essentially all of a weight of the catenary riser section determined in water is transferred to the floating unit via the connection portion.

4. The offshore top site system as claimed in claim 1, wherein the catenary riser section has a length of at least about 2000 m.

5. The offshore top site system as claimed in claim 1, wherein at most about 25% of a weight of the catenary riser section is borne by buoyancy module(s).

6. The offshore top site system as claimed in claim 1, wherein the catenary riser section is free of any buoyancy module.

7. The offshore top site system as claimed in claim 1, wherein the connection portion is arranged outside the vertical floating unit zone.

8. The offshore top site system as claimed in claim 1, wherein the floating unit has an outer frame defining the outer periphery of the bottom, wherein the connection portion is pivotally connected to the floating unit at its outer frame.

9. The offshore top site system as claimed in claim 1, wherein the connection portion is arranged within the vertical floating unit zone.

10. The offshore top site system as claimed in claim 1, wherein the connection portion is arranged below the bottom of the floating unit.

11. The offshore top site system as claimed in claim 1, wherein the connection portion is arranged above the bottom of the floating unit.

12. The offshore top site system as claimed in claim 1, wherein the catenary riser section comprises two or more sub sections which sub-sections are different from each other.

13. The offshore top site system as claimed in claim 1, wherein the catenary riser section and the top site section of the transportation line are connected to each other via respective end-fittings, wherein at least one of the respective end-fittings provides the connection portion pivotally connected to the floating unit.

14. The offshore top site system as claimed in claim 1, wherein the catenary riser section and the top site section of the transportation line are connected to each other via respective end-fittings and with one or more intermediate transition pieces, wherein at least one of the transition pieces provides the connection portion pivotally connected to the floating unit.

15. The offshore top site system as claimed in claim 14, wherein the at least one of the transition pieces is shaped as a pull-head.

16. The offshore top site system as claimed in claim 1, wherein the floating unit is a vessel having a hull with a bow and a stern.

17. The offshore top site system as claimed in claim 16, wherein the connection portion is pivotally connected to the vessel.

18. The offshore top site system as claimed in claim 16, wherein the connection portion is pivotally connected to the vessel by being directly and pivotally connected to the bow.

19. The offshore top site system as claimed in claim 16, wherein the vessel comprises a load support shelf connected to and protruding from the hull, wherein the connection portion is pivotally connected to the vessel by being pivotally connected to the load support shelf.

20. The offshore top site system as claimed in claim 16, wherein the vessel comprises an opening through the hull, the catenary riser section extends through the opening in the hull and the connection portion is pivotally connected to the floating unit by being connected to an internal bearing structure of the vessel.

21. The offshore top site system as claimed in claim 1, wherein the connection portion is pivotally connected to the floating unit using one or more tether lines.

22. The offshore top site system as claimed in claim 1, wherein the connection portion is pivotally connected to the floating unit via at least one non-elongating connection.

23. The offshore top site system as claimed in claim 1, wherein the connection portion is pivotally connected to the floating unit using at least one tether line, the tether line is connected to the floating unit in a connection point, the system further comprises a bell mouth mounted to adjust a pivotal movement of the tether line.

24. The offshore top site system as claimed in claim 1, wherein the system further comprises a hanging support structure arranged below the bottom of the floating unit, wherein the connection portion is pivotally connected to the floating unit via the hanging support structure.

* * * * *